US007144174B2

(12) United States Patent
Erickson et al.

(10) Patent No.: US 7,144,174 B2
(45) Date of Patent: Dec. 5, 2006

(54) APPLICATOR FOR LIQUID COSMETIC COMPOSITIONS

(75) Inventors: Gregory Alan Erickson, S. Elgin, IL (US); Liang Bin Chen, Hoffman Estates, IL (US)

(73) Assignee: Unilever Home & Personal Care USA division of Conopco, Inc., Chicago, IL (US)

( * ) Notice: Subject to any disclaimer, the term of this patent is extended or adjusted under 35 U.S.C. 154(b) by 0 days.

(21) Appl. No.: 11/026,169

(22) Filed: Dec. 30, 2004

(65) Prior Publication Data

US 2006/0147251 A1 Jul. 6, 2006

(51) Int. Cl.
*B43K 5/00* (2006.01)
*B05C 11/00* (2006.01)

(52) U.S. Cl. ..... 401/199; 401/198; 401/266

(58) Field of Classification Search ..... 401/196, 401/198, 199, 265, 266
See application file for complete search history.

(56) References Cited

U.S. PATENT DOCUMENTS

| | | | | |
|---|---|---|---|---|
| 3,393,963 | A | 7/1968 | Nadai | 401/207 |
| 4,480,940 | A | 11/1984 | Woodruff | 401/206 |
| 4,795,156 | A | 1/1989 | Paulish | 273/148 |
| 4,913,175 | A | 4/1990 | Yokosuka et al. | 132/317 |
| 5,073,057 | A | 12/1991 | Lathrop et al. | 401/206 |
| 5,154,193 | A | 10/1992 | Busch et al. | 132/110 |
| 5,454,660 | A | 10/1995 | Sakurai et al. | 401/266 |
| 5,480,250 | A | 1/1996 | Birden | 401/199 |
| 5,551,789 | A * | 9/1996 | Okawa et al. | 401/199 |
| 5,899,622 | A | 5/1999 | Gueret | 401/122 |
| 5,964,226 | A * | 10/1999 | Sobel | 132/108 |
| 6,030,138 | A | 2/2000 | Losier | 401/266 |
| 6,095,707 | A | 8/2000 | Kaufmann | 401/199 |
| 6,164,858 | A | 12/2000 | Kaufmann | 401/205 |
| 6,183,155 | B1 | 2/2001 | Kaufmann | 401/199 |
| 6,234,698 | B1 | 5/2001 | De Laforcade | 401/175 |
| 6,276,860 | B1 * | 8/2001 | Nakajima et al. | 401/199 |
| 6,309,128 | B1 | 10/2001 | Griebel et al. | 401/264 |
| 6,416,242 | B1 | 7/2002 | Kaufmann | 401/198 |
| 6,604,879 | B1 | 8/2003 | Gueret | 401/190 |
| 6,682,244 | B1 | 1/2004 | Gueret | 401/208 |
| 6,682,246 | B1 | 1/2004 | Reggiani | 401/264 |
| 6,692,173 | B1 * | 2/2004 | Gueret | 401/202 |
| 6,715,951 | B1 | 4/2004 | Gueret | 401/130 |
| 6,773,187 | B1 | 8/2004 | Gueret | 401/130 |
| 6,776,549 | B1 | 8/2004 | Gueret | 401/170 |
| 6,883,991 | B1 | 4/2005 | Gueret | 401/130 |
| 2003/0129016 | A1 | 7/2003 | Gueret | 401/202 |

FOREIGN PATENT DOCUMENTS

| | | |
|---|---|---|
| EP | 523 061 | 1/1943 |
| WO | 98/12122 | 3/1998 |
| WO | 2004/062423 | 7/2004 |

* cited by examiner

*Primary Examiner*—David J. Walczak
(74) *Attorney, Agent, or Firm*—Karen E. Klumas

(57) ABSTRACT

An applicator for liquid cosmetic products, wherein product is dispensed primarily by capillary flow of the cosmetic product through the applicator and wherein the liquid cosmetic composition has a flow rate outward from the porous polymeric applicator head of about 0.05 to about 1.0 cc/s when a pressure gradient of 0.5 psi is applied across the applicator device. The cosmetic products are preferably antiperspirant and/or deodorant products comprising an antiperspirant and/or deodorant active.

7 Claims, 5 Drawing Sheets

APPLICATOR FOR LIQUID COSMETIC COMPOSITIONS

FIELD OF INVENTION

The present invention relates to applicators for liquid cosmetic products, and particularly applicators for liquid cosmetic products applied to the human body. More particularly, the invention is directed to applicators for cosmetic products in which product is dispensed primarily by capillary flow of the cosmetic product through the applicator. The cosmetic products are preferably antiperspirant and/or deodorant products comprising an antiperspirant and/or deodorant active.

BACKGROUND

Antiperspirant and deodorant products come in many different forms including sticks, gels, soft solids, roll-ons and aerosols. These product forms are typically packaged in different types of dispensers that are suitable for delivering the specific product form. Dispensers for such product forms can be classified as either contact dispensers (sometimes called applicators) or non-contact dispensers. Non-contact dispensers are such that dispenser does not come in contact with the surface upon which product is to be applied. Non-contact dispensers include aerosol and spray dispensers. Within the class of contact dispensers, a further differentiation can be made between a first subclass adapted to dispense flowable materials and a second subclass of dispensers which include an internal means to transport a non-flowable material, such as a solid or hard gel towards a dispensing aperture. For identification purposes, this second subclass of contact dispensers are referred to herein as "stick dispensers".

As previously stated, in stick dispensers, internal means typically transport the solid product towards a dispensing aperture. In stick dispensers, in order to apply product, the solid product is contacted against the surface upon which the product is to be applied (e.g. user's underarm area). Therefore, in stick dispensers the application surface is the product itself.

Unlike stick dispensers, in the first subclass of contact dispensers referenced above the application surface is a part of the dispenser as opposed to the product itself. Such contact applicators commonly have a surface that contains on it a thin layer of the product. The product is a flowable product that will spread on the application surface of the dispenser and on the surface upon which the product is to be applied (e.g. user's underarm area). Typical examples of such applicators are roll-on or porous applicators. In such applicators a part of the dispenser acts as the application surface as opposed to the product itself. The application surface is contacted against the surface upon which the product is to be applied (e.g. user's underarm area) and a thin coating of product is transferred from the application surface to the surface upon which the product is to be applied. While roll-on type dispensers are the primary and most popular of this subclass of contact dispensers, other types of dispensers that fall within this first subclass of applicators are known, such as an applicator having an application surface which is a porous dome as disclosed in EP Application No. 03250205.6, the disclosure of which is incorporated by reference. For identification purposes, this first class of contact dispensers are referred to herein as "liquid contact applicators". For identification purposes, liquid contact applicators having a porous dome application surface, such as those disclosed in EP Application No. 03250205.6, are referred to herein as "porous dome applicators".

Porous dome applicators have typically operated by a combination of force created by capillary action assisted by an applied mechanical force wherein the internal volume of the container is reduced thereby creating a force to push the product out of the container. Porous dome applicators in which the product is forced to flow by only or primarily capillary action have been subject to several problems. These applicators have been found to not provide ample payout (i.e. the amount of product that is dispensed during operation) and thus have required the use of additional mechanical forces whereby the internal volume of the container is reduced in order to increase the payout. The requirement of reducing the internal volume of the container detracts from the simple application technique that is desired from porous dome applicators, which unlike some other dispensers/applicators do not require the user to reduce the internal volume of the container in order to dispense product. Porous dome applicators are desired for other reasons as well, such as the type of formulations that can be used to them.

An object of the present invention is to provide a dispenser which is a porous dome applicator having ample payout and whereby the internal volume of the container does not need to be reduced to provide the ample payout. The porous dome applicators of the present invention provide ample payout without the need for reducing the internal volume of the container thus providing an easy to use dispenser to the user.

Other objects of the present invention will become apparent to those skilled in the art by reference to the specification.

SUMMARY OF THE INVENTION

In a first aspect, the present invention is directed to a device for applying a liquid cosmetic composition, the device comprising a porous polymeric applicator head, an absorbent material fixed in intimate contact therewith, and a reservoir for the liquid cosmetic composition from which said composition is delivered to the absorbent material which in turn delivers the liquid cosmetic composition to the porous polymeric applicator head, wherein the liquid cosmetic composition has a flow rate outward from the porous polymeric applicator head of about 0.05 to about 1.0 cc/s when a pressure gradient of 0.5 psi is applied across the applicator device. A pressure gradient applied across the applicator device is the gradient between the pressure in the liquid cosmetic reservoir and the ambient pressure.

In a second aspect, the present invention is directed to a device for applying a liquid cosmetic composition, the device comprising a porous polymeric applicator head and a reservoir for the liquid cosmetic composition from which said composition is delivered to the porous polymeric applicator head, wherein the liquid cosmetic composition has a flow rate outward from the porous polymeric applicator head of about 0.05 to about 1.0 cc/s when a pressure gradient of 0.5 psi is applied across the applicator device.

In a third aspect, the present invention is directed to device for applying a liquid cosmetic composition, the device comprising a porous polymeric applicator head, an absorbent material fixed in intimate contact therewith, and a reservoir for the liquid cosmetic composition from which said composition is delivered to the absorbent material which in turn delivers the liquid cosmetic composition to the porous polymeric applicator head, wherein the liquid cosmetic composition, the porous polymeric applicator head, and absorbent material have a flow parameter between about 1.0×10 e−6 to about 6.0×10 e−7, and wherein the flow parameter is defined as:

$$\text{Flow parameter } (FP)=Q/A\Delta P$$

where Q=flow rate (cc/sec)
A=contact area ($cm^2$)
ΔP=pressure gradient (psi)

In a fourth aspect, the present invention is directed to device for applying a liquid cosmetic composition, the device comprising a porous polymeric applicator head and a reservoir for the liquid cosmetic composition from which said composition is delivered to the porous polymeric applicator head, wherein the liquid cosmetic composition and porous polymeric applicator head have a flow parameter between about 1.0×10 e−6 to about 6.0×10 e−7 as previously defined.

All percentages in the specification and claims, unless indicated otherwise, are intended to be percentages by weight.

All numerical ranges in this specification and claims are intended to be modified by the term "about".

As used herein, the term "comprising" means that a specified material or element is present, optionally together a further material or element, and includes including, made up of, composed of, consisting and/or consisting essentially of.

For a more complete understanding of the above and other features and advantages of the invention, reference should be made to the following detailed description of preferred embodiments.

DETAILED DESCRIPTION OF THE INVENTION

As mentioned hereinabove, in accordance with the various aspects, the invention is directed to a device for applying a liquid cosmetic composition. In one embodiment, the device comprises a porous polymeric applicator head and an absorbent material fixed in intimate contact therewith and a reservoir for the liquid cosmetic composition from which said composition is delivered to the absorbent material which in turn delivers the liquid cosmetic composition to the porous polymeric applicator head. In other embodiments, the device may have a porous polymeric applicator head, which is in direct contact with the reservoir for the liquid cosmetic composition such that there is no need for an absorbent material between the porous polymeric applicator head and liquid reservoir. The liquid cosmetic composition is delivered through the porous polymeric head solely or primarily by capillary action while providing ample payout. When it is said that the delivery mechanism is primarily by capillary action or force, it is meant that mechanical means are not used to force the delivery of liquid, however other forces such as gravitational forces may be at work to help or assist the delivery of liquid. In order to provide ample payout, the liquid cosmetic composition has a flow rate outward from the porous polymeric applicator head of about 0.05 to about 1.0 cc/s when a pressure gradient of 0.5 psi is applied across the applicator device. In order to achieve such ample payout under such conditions and while relying on solely or predominantly capillary force for delivering the liquid cosmetic composition, it has been found that the device must be designed with the correct configuration and materials to provide the proper flow parameter.

The flow parameter ("FP") is defined as:

$$FP=Q/A\Delta P$$

where Q=flow rate (cc/sec)
A=contact area ($cm^2$)
ΔP=pressure gradient (psi)

This flow parameter is derived from the formula;

$$Q=kA\Delta P/nL$$

where Q=flow rate (cc/sec)
k=permeability of liquid in porous material in the delivery system (cm2)
A=contact area (cm2)
ΔP=pressure gradient (psi)
n=viscosity (g/(cm*sec)
L=length of porous material (cm)

One can rearrange the flow equation and get a flow parameter:

$$FP=Q/A\Delta P=k/nL$$

The device is intended for use with cosmetic liquid materials that flow readily, especially those having a viscosity of less then 100 centipoise, and preferably those having a viscosity less than 30 centipoise, more preferably less than 20 centipoise, even more preferably less than 15 centipoise, yet more preferably less than 10 centipoise, and most preferably less than 5 centipoise.

The device is designed to provide ample payout at a pressure gradient of 0.5 psi. The pressure gradient is the gradient between the pressure in the liquid cosmetic reservoir and the ambient pressure. The payout at a pressure gradient of 0.5 psi was chosen as representative of a pressure gradient that may be found upon use of such a device. However, the pressure gradient that will be found upon use will vary from user to user as it is dependent upon factors such as the users skin and manner of operation by the user as well as other factors including product configuration. In any case, the present invention is directed to devices that have a defined flow parameter when placed under a pressure gradient of 0.5 psi.

In a particular embodiment of the invention, the porous polymeric applicator head is at the top of the device, with the absorbent material in intimate contact immediately beneath, and the reservoir for the liquid composition immediately beneath the absorbent material. In such a device, the applicator head and absorbent material may be filled with the liquid composition by holding or storing the device in an inverted position prior to use and then applying the composition with the device orientated so that the applicator head is at the top. In such a configuration, the liquid in the reservoir flows freely within the reservoir and is not necessarily held in contact with the absorbent material or porous polymeric applicator head. Having the liquid composition in the reservoir free to separate from the absorbent material during use, but not during storage, is a means of achieving orientation dependent contact between the liquid composition in the reservoir and the absorbent material.

In another embodiment, there can be orientation dependent contact between the liquid composition in the reservoir and the applicator head. In such an embodiment, the porous polymeric applicator head is at the top of the device with the reservoir for the liquid composition immediately beneath the applicator head. In such a device, the applicator head may be loaded with the liquid composition by holding or storing the device in an inverted position prior to use and then applying the composition with the device orientated so that the applicator head is at the top.

In an alternative embodiment of the invention, the device comprises a means for maintaining contact between the liquid composition in the reservoir and the absorbent material independent of the orientation of the device. Such an embodiment enables continuous delivery of the liquid composition to the applicator head via the absorbent material, during application, independent of the orientation of the device. Suitable means for maintaining contact between the liquid composition in the reservoir and the absorbent material independent of the orientation of the device include one or more wick-like extensions to the absorbent material that extend to the bottom of the reservoir for the liquid composition. Preferably the one or more wick-like extensions are made of the same material as the absorbent material.

In another embodiment, the liquid cosmetic composition may be stored in a fiber reservoir. In such an embodiment, the absorbent material is loaded directly from the fiber reservoir and the loading is independent of the orientation of the device.

It is preferable that the liquid is caused to flow by capillary action. Accordingly, a pressure gradient should be created between the reservoir and the ambient pressure in order to cause product to flow by capillary action. This may be achieved by contacting the outer surface of the applicator head with another surface, such as skin, as opposed to creating internal pressure by altering the internal volume of the device (e.g. squeezing the device).

Throughout this specification, references to the "top" and "bottom", etc., relate to the device in its predominant in-use orientation. As such, the "top" is the end of the device from which the liquid cosmetic composition flows out.

The porous polymeric applicator head is typically made of a non-flexible, non-deformable, sintered, material. Suitable materials are porous synthetic resins having omni-directional interconnecting pores, optionally formed from aggregates of united polymer particles. The material may be high-density polyethylene, low-density polyethylene, ultra-high molecular weight polyethylene, polypropylene, or polyvinylidene fluoride. A suitable commercial product is "Porex™", available from Porex Technologies Inc. The pore size of the applicator head is typically from 1 to 200 microns, in particular from 10 to 100 microns, and especially from 15 to 75 microns. In yet other embodiments, the applicator head may be made a plastic material with fines holes formed in it such that the liquid composition may pass through via capillary action.

A flexible absorbent material may be placed over the top outer surface of the porous polymeric applicator head. This flexible absorbent material may assist in holding product in a position to be delivered upon used of the device. The cosmetic product may be released from the flexible absorbent material by either mechanical force (e.g. compression) or by capillary action or a combination thereof.

It is preferred that the outer face of the applicator head is domed, in order to enhance the comfort in use of the product.

The absorbent material fixed in intimate contact with the bottom surface of the porous polymeric applicator head transfers the liquid composition through to the applicator head by capillary flow. The contact is generally between an inner surface of the applicator head and an outer surface of the absorbent material. The contact may be between predominantly flat surfaces or the surfaces may be uneven; in the latter case, it is preferred that the unevenness in the surfaces mirror one another such that intimate contact between the surfaces is enabled across predominantly all of relevant surface areas. This latter feature of the surfaces may be of help during manufacture of the device, aiding the location of the applicator head relative to the absorbent material. A particular embodiment is ridges in the outer surface of the absorbent material and corresponding hollows in the inner surface of the applicator head.

The absorbent material may be any material that is capable of absorbing the liquid composition to be applied and allowing its wicking through to the applicator head. Fibrous materials or open foams are suitable. Particularly suitable fibrous materials have a fibre density of from 40% to 60% by volume. Examples of suitable materials include cellulose acetate, polyester, cotton, rayon, and nylon. A suitable commercial product is PT Trasorb, available from Filtrona International Ltd. Suitable open foam materials include polyether and polyester foams, in particular, materials having from 60 to 90 pores per linear inch (152 to 229 pores per linear cm) and/or a compressibility of down to from one ninth to one quarter its original size).

The absorbent material needs to have a certain "holding capacity" for the liquid composition. This may be defined as the maximum amount of liquid composition that can be held by one gram of absorbent material under standard conditions of pressure and temperature (i.e. 1 atmosphere and 25° C.). It is preferred that the holding capacity of the absorbent material is greater than the analogously defined holding capacity of the porous polymeric applicator head. In absolute terms, the holding capacity for the absorbent material is preferably 1.0 g/g or greater, more preferably 2.0 g/g or greater, and most preferably 3.0 g/g or greater, where the figures refer to grams of liquid composition held per gram of dry absorbent material.

It is preferred that the total capacity of the absorbent material for the liquid cosmetic composition is less than the amount of liquid cosmetic composition that may be held in the reservoir. In devices lacking a means for maintaining contact between the liquid composition in the reservoir and the absorbent material when the product is in use, it is important that the total capacity of the absorbent material for the liquid cosmetic composition is sufficient for the desired dose of product to be delivered. When a particular "unit dose" is desired from such a product, the total capacity of the absorbent material should be chosen accordingly. Such a total capacity may be from 1 g to 100 g, in particular from 2 g to 50 g, and, especially for products intended for use on the human skin, from 2 g to 5 g.

The absorbent material may have one or more wick-like extensions to the absorbent material that extend to the bottom of the reservoir for the liquid composition. Such an extension may be centrally located or it may extend from the periphery of the absorbent material. This latter location ensures contact with the liquid composition within the reservoir whatever the orientation of the device.

The reservoir for the liquid cosmetic composition is a contained space for holding the composition. The contained space excludes the absorbent material in intimate contact with the applicator head. It is essential that there is means for the composition to be delivered from the reservoir to the absorbent material. In a typical embodiment of the invention, this means is provided by having the lower face of the absorbent material as the upper boundary of the reservoir. In this typical embodiment, the reservoir may be defined by said lower face of the absorbent material together with a sidewall and a base. Said base may be concave on its inner surface; this can lead to enhanced transfer of the liquid composition to the absorbent material in embodiments comprising a centrally located wick-like extension (vide supra).

In general use, the device may be held by the consumer in the region of the sidewall that partially defines the reservoir. It is preferred that the outer cross-section of this region of the device is designed for easy handling by the consumer. Suitable cross-sectional shapes include a circle and an ellipse.

It is highly preferred that the absorbent material has a sidewall around its periphery in order to avoid possible contact between the periphery of the absorbent material and the user's body. Such contact may be perceived as less pleasing than contact with the porous polymeric applicator head. This sidewall may be continuous with the container wall or a sidewall of the reservoir.

The containing walls of the reservoir and the sidewall around the absorbent material, when present, may be made from a material impervious to the fluid to be dispensed. Typical materials are plastics, such as polyolefins like polypropylene or polyethylene or addition copolymers, such as nylon or PET/POET.

In certain embodiments, the reservoir takes the form of a collapsible bag. Such embodiments may have the advantage that venting of the reservoir is not.

A vent giving the absorbent material and/or the reservoir access to the atmosphere is a preferred feature of devices as described in the present invention. The vent may serve to relieve pressure changes within the device caused by changes in the surrounding temperature or atmospheric pressure. Excess pressure may be relieved by a vent in a sidewall or base of the reservoir; examples of such vents include pressure-sensitive one-way valves and gas permeable membranes. When a sidewall is present that surrounds all of the otherwise exposed absorbent material, the device preferably comprises a vent giving direct access of the absorbent material to the atmosphere. The vent may be present in the sidewall around the absorbent material or it may result from the porous polymeric applicator head not completely covering the upper face of the absorbent material. The vent can serve to alleviate any build up of negative pressure within device, such as may otherwise occur during product application and be detrimental there to.

A cap for covering the applicator head is a desired additional feature of the device. Such a cap can prevent accidental contact with the applicator head and reduce the loss of any volatile components from the composition within the pores of the applicator head. The cap preferably contacts the sidewall around the absorbent material. The cap may be hinged onto said sidewall or may be fully removable. A fully removable cap may be held onto said sidewall by a screw-thread or a simply by friction between the inner surface of a sidewall of the cap and the outer surface of the absorbent material or a sidewall around it, for example a snap fit. When a vent, as previously described, is present the cap may cover the vent. Preferably, the cap does not form an air-tight seal over the applicator head; this may be achieved by having a vent present in the cap itself.

The cosmetic composition is a liquid at standard conditions of pressure and temperature. The liquid cosmetic composition may be of any type; for example, it may be a hair care product, a perfume, a deodorant, or an antiperspirant. Deodorant or antiperspirant compositions are particularly suitable and are preferred. The components typically present in such compositions may be included in compositions for use in the present invention.

It is highly preferred that the composition does not comprise solid particulates larger in size than the pores of the porous polymeric applicator head. Such particulates can lead to blockage of the pores in the applicator head and/or detract from the sensory performance of the product. More preferably, the composition does not comprise any solid particulate material, for the same reasons. In preferred embodiments, the pore size of the porous polymeric applicator head is 10 microns or greater, and the composition does not comprise any particulates that are 10 microns or greater in size.

The liquid cosmetic composition frequently comprises a liquid carrier fluid; for example, a C2 to C4 alcohol like ethanol, propylene glycol, propanol, or iso-propanol. Such compositions can give particularly good sensory properties when applied according to the present invention. Suitable liquid compositions typically comprise C2 to C4 alcohol at a level of from 5% to 95%, in particular from 25% to 80%, and especially from 40% to 75% by weight of the composition. Liquid compositions comprising ethanol are particularly suitable.

The liquid carrier fluid may also comprise water; for example, in an amount from 0.1% to 60% by weight of the composition. Compositions comprising water and a C2 to C4 alcohol, in particular ethanol, are especially preferred.

The examples which follow are provided to facilitate an understanding of the present invention. The examples are not intended to limit the scope of the claims.

Figure 3:
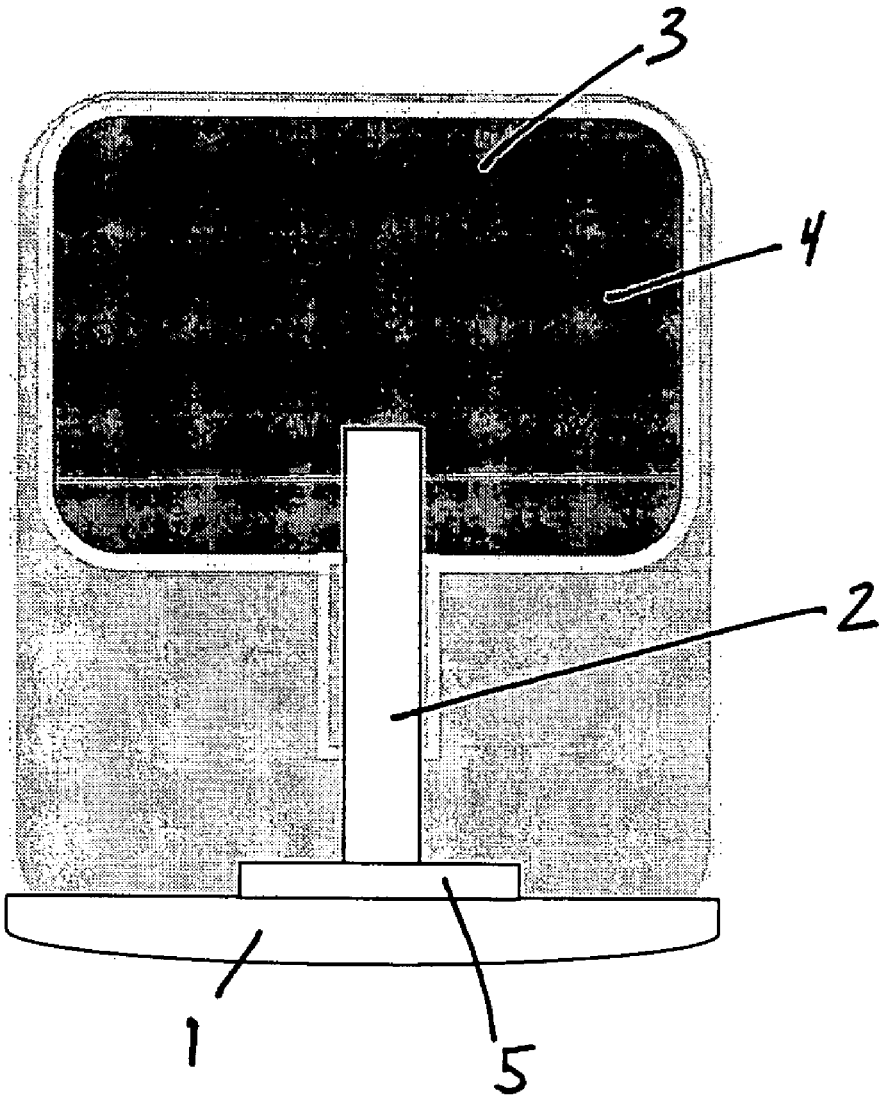

FIG. 3 represents a vertical central cross-section through a product according the invention wherein a fiber transfer disk 5 is in contact with the absorbent material 2 and the porous polymeric applicator head 1 and wherein the absorbent material 2 is not in direct contact with the porous polymeric applicator head 1 but rather is in contact with the fiber transfer disk 5.

Figure 4:
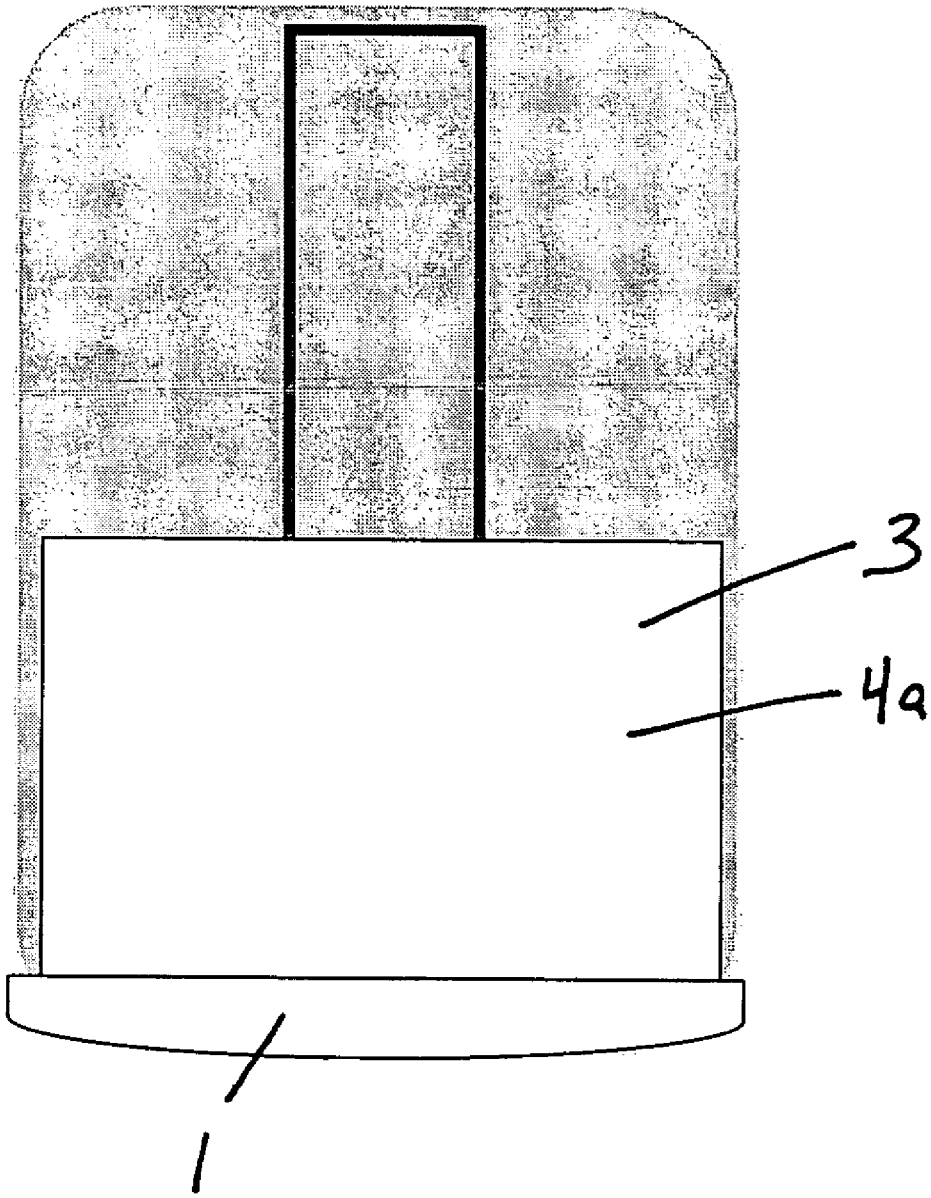

FIG. 4 represents a vertical central cross-section through a product according the invention wherein the liquid cosmetic product 3 is in a fiber reservoir 4*a* which is in contact with the porous polymeric applicator head 1.

Figure 1:
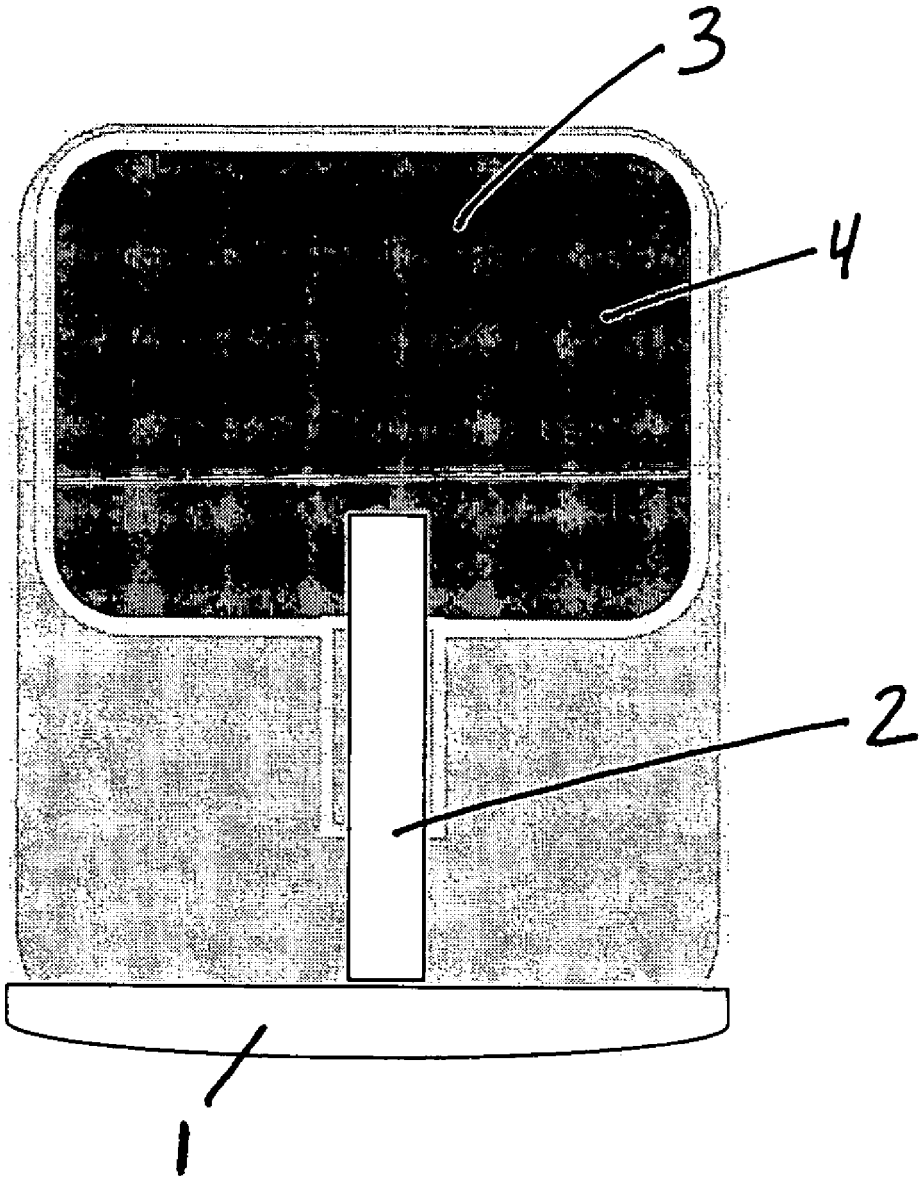
FIG. 1 represents a vertical central cross-section through a product according the invention wherein the absorbent material 2 is in contact with the porous polymeric applicator head 1.
Figure 2:
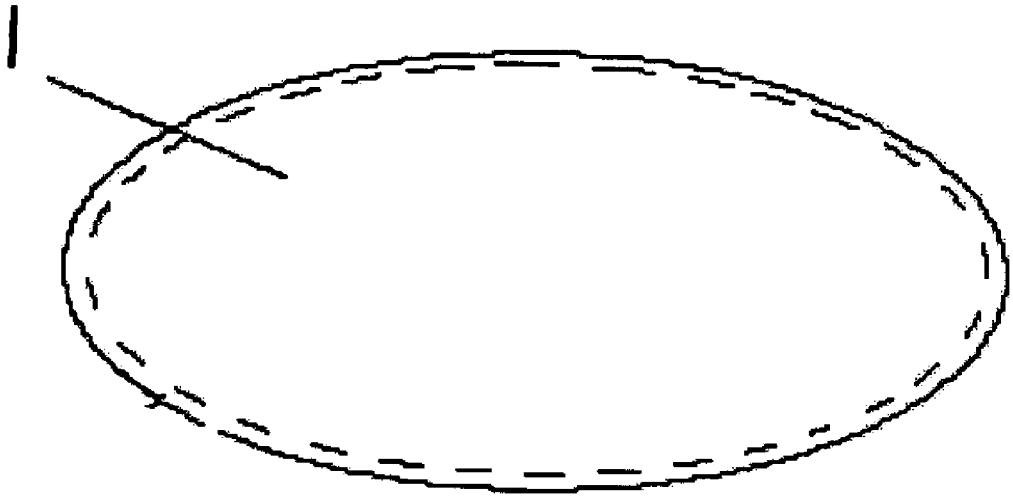
FIG. 2 represents a top perspective of the embodiments illustrated in FIGS. 1, 3, and 4. The top surface of the porous polymeric applicator head 1 is seen in this view.

In FIGS. 1, 3, and 4, the porous polymeric applicator head 1 is at the top of the device and is fixed in intimate contact with absorbent material 2 or fiber reservoir 4*a*, immediately below. In FIGS. 1 and 3, the liquid cosmetic composition 3 is held within reservoir 4 below the absorbent material 2. In FIG. 4, the liquid cosmetic composition is held in the fiber reservoir 4*a*.

Figure 5:
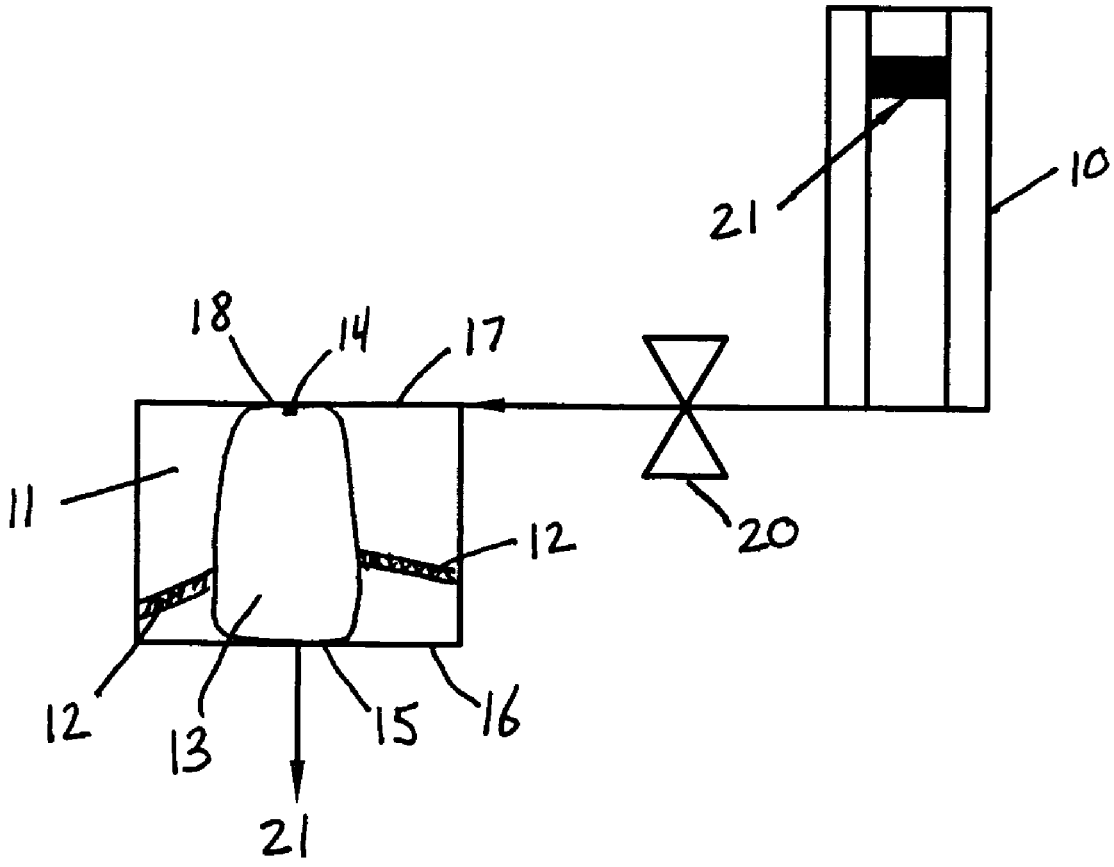

FIG. 5 is a diagram of the testing apparatus used to measure the flow rate in the device under a pressure gradient of 0.5 psi.

The test procedure to measure the liquid permeability of the various samples is as follows. The different sample configurations were tested on the same Perm-Porometer (CFP 1100 AEXL from Porous Material Inc. (PMI).) 10. These configurations were all unique in the way they were arranged, but were all tested in the same way as can any unique configuration. In all cases the configurations were put together dry. A hole 14 was drilled through the bottoms of all devices and chambers to allow them to be filled with a test fluid having a viscosity of less then 100 centipoise. The configurations were filled with fluid until completely saturated. The configurations were then placed face down into a sample chamber 11 and attached to the Perm-Porometer 10.

The sample chamber was fitted with attachments 12 to hold the samples 13. The attachments may be configured to hold any sample geometry as long as they can hold the sample to be tested.

The top of the device 15 was then sealed to the bottom 16 of the sample chamber 11. To accomplish this, the dome at the top of the device was sealed to the bottom 16 of the sample chamber 11 with the help of a mold cast using liquid rubber. The top 17 of the sample chamber 11 pressed against the bottom 18 of the device in which a small hole 14 was drilled for entry of the liquid. The small hole 14 drilled at the bottom 18 of the device was sealed with the top 17 of the sample chamber 11 with a small o-ring around the hole.

With the configuration properly sealed into place liquid permeability tests were performed. For testing the samples the valve 20 was opened at the beginning of each test and liquid from the penetrometer 10 flowed through the sample device due to gravity. The liquid exited the device at the top 15 of the device and flowed in the direction indicated by 21. The position of the magnetic float 21 determined the rate of fluid flow and pressure.

Table 1 shows results of the measured flow rate at 0.5 psi. From this data, the flow parameter (FP) was calculated and shown in Table 1.

TABLE 1

| Configuration (Figure #) | Q cc/sec (at 0.5 psi) | FP $cm^2sec/g$ |
|---|---|---|
| 1 | 0.245 | 5.01E−07 |
| 1 | 0.518 | 1.04E−06 |
| 3 | 0.199 | 4.06E−07 |
| 4 | 0.715 | 1.46E−06 |
| 4 | 0.626 | 1.28E−06 |
| 4 | 0.688 | 1.41E−06 |

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A device for applying a liquid cosmetic composition, said device having a closed end and an end for outward flow of the liquid cosmetic composition comprising a porous polymeric applicator head at the end for outward flow, an absorbent material fixed in intimate contact therewith, and a reservoir for the liquid cosmetic composition from which said composition is delivered to the absorbent material which is in turn delivered to the porous polymeric head and flows outward, and wherein the liquid cosmetic composition has a flow rate outward from the porous polymeric applicator head of about 0.05 to about 1.0 cc/s when a pressure gradient of 0.5 psi is applied across the applicator device.

2. A device for applying a liquid cosmetic composition in accordance with claim 1, wherein the liquid cosmetic composition has a flow rate outward from the porous polymeric applicator head of about 0.1 to about 0.7 cc/s when a pressure gradient of 0.5 psi is applied across the applicator device.

3. A device for applying a liquid cosmetic composition in accordance with claim 1, wherein the liquid cosmetic composition has a flow rate outward from the porous polymeric applicator head of about 0.3 to about 0.6 cc/s when a pressure gradient of 0.5 psi is applied across the applicator device.

4. A device for applying a liquid cosmetic composition in accordance with claim 1, wherein the liquid cosmetic composition has a flow rate outward from the porous polymeric applicator head of about 0.4 to about 0.5 cc/s when a pressure gradient of 0.5 psi is applied across the applicator device.

5. A product according to claim 1 wherein the liquid cosmetic composition is driven primarily by capillary action and wherein the internal volume of the device is not altered by a mechanical force.

6. A product according to claim 1 wherein the liquid cosmetic composition is driven purely by capillary action.

7. A device comprising a liquid cosmetic composition, said device having a closed end and an end for outward flow of the liquid cosmetic composition comprising a porous polymeric applicator head at the end for outward flow, an absorbent material fixed in intimate contact therewith, and a reservoir for the liquid cosmetic composition from which said composition is delivered to the absorbent material, wherein the liquid cosmetic composition has a viscosity of less than 100 centipoise, and the porous polymeric applicator head and absorbent material have a flow parameter between 1.0×10 e−6 to about 6.0×10 e−7.

* * * * *